US012433351B2

(12) United States Patent
Asbeck et al.

(10) Patent No.: US 12,433,351 B2
(45) Date of Patent: Oct. 7, 2025

(54) ARTICLE OF CLOTHING CONFIGURED TO PROVIDE SIGNALS UPON OBJECT RECOGNITION

(71) Applicants: ORBIS TEXTIL GMBH & CO. KG, Halver (DE); DUOTEC HOLDING SA, Delémont (CH); NORES UG, Halver (DE)

(72) Inventors: Christian Asbeck, Gevelsberg (DE); Domenic Blaetgen, Halver (DE); Lukas Joslowski, Iserlohn (DE); Arthur Roenisch, Kierspe (DE); Marc Ungemach, Herne (DE); Annika Isabell Wallmann, Halver (DE); Jens Wallmann, Halver (DE)

(73) Assignee: DUOTEC HOLDING SA, Delémont (CH)

( * ) Notice: Subject to any disclaimer, the term of this patent is extended or adjusted under 35 U.S.C. 154(b) by 357 days.

(21) Appl. No.: 17/904,878

(22) PCT Filed: Feb. 24, 2021

(86) PCT No.: PCT/EP2021/054568

§ 371 (c)(1),
(2) Date: Mar. 6, 2023

(87) PCT Pub. No.: WO2021/170663

PCT Pub. Date: Sep. 2, 2021

(65) Prior Publication Data

US 2024/0023643 A1 Jan. 25, 2024

(30) Foreign Application Priority Data

Feb. 24, 2020 (EP) ..... 20158934
Nov. 30, 2020 (EP) ..... 20210727

(51) Int. Cl.
*A41D 13/01* (2006.01)
*A41D 1/02* (2006.01)

(52) U.S. Cl.
CPC ..... *A41D 13/01* (2013.01); *A41D 1/02* (2013.01)

(58) Field of Classification Search
CPC ..... A41D 13/01; G08B 5/00
See application file for complete search history.

(56) References Cited

U.S. PATENT DOCUMENTS 4,068,130 A * 1/1978 Malinowski ..... G08B 17/107 340/630
4,075,499 A * 2/1978 Malinowski ..... G08B 17/107 340/630

(Continued)

FOREIGN PATENT DOCUMENTS

DE 102016209460 11/2017
DE 102016116028 1/2018

(Continued)

OTHER PUBLICATIONS

English translation of International Search Report from corresponding PCT Appln. No. PCT/EP2021/054568, dated May 14, 2021.

(Continued)

*Primary Examiner* — Hoi C Lau
(74) *Attorney, Agent, or Firm* — Grossman, Tucker, Perreault & Pfleger, PLLC

(57) ABSTRACT

An article of clothing, in particular a jacket, comprising a plurality of cut parts each cut to size from a fabric and sewn together, the article of clothing including electronic components. As electronic components, the article of clothing comprises at least one sensor unit for detecting a presence of an external object, a control unit 4, and an electronic signal generator unit, wherein the control unit is designed to receive measured values from the sensor unit during an (Continued)

operating phase of the article of clothing and to transmit control signals generated as a function of the read measured values to the signal generator unit, the signal generator unit being designed to output a predefined signal which can be perceived by a wearer of the article of clothing and/or by an external observer of the article of clothing on receipt of a predefined control signal.

24 Claims, 2 Drawing Sheets

(56) References Cited

U.S. PATENT DOCUMENTS

| | | | | |
|---|---|---|---|---|
| 5,162,838 | A * | 11/1992 | Inuzuka | H04N 1/00602 358/401 |
| 6,963,354 | B1 * | 11/2005 | Scheps | G01S 17/88 348/31 |
| 10,043,368 | B1 * | 8/2018 | Fonzi, III | G08B 21/0446 |
| 10,299,704 | B2 * | 5/2019 | Cloutier | A61B 5/4818 |
| 10,653,192 | B2 * | 5/2020 | Chen | A41D 13/01 |
| 11,311,059 | B2 * | 4/2022 | Greszler | G08B 21/14 |
| 11,612,772 | B2 * | 3/2023 | Roth | A62B 35/0081 182/36 |
| 11,744,299 | B2 * | 9/2023 | Lopez | G06F 1/163 2/69 |
| 2003/0213045 | A1 * | 11/2003 | Fuentes | B60Q 1/2673 2/69 |
| 2007/0242470 | A1 * | 10/2007 | Michiyama | B60Q 1/20 362/464 |
| 2011/0156926 | A1 * | 6/2011 | Chen | H05B 45/10 315/158 |
| 2015/0294597 | A1 * | 10/2015 | Rizzo | A61H 3/061 340/4.12 |
| 2016/0171864 | A1 * | 6/2016 | Ciaramelletti | A42B 3/046 340/539.11 |
| 2016/0187654 | A1 * | 6/2016 | Border | G02B 27/0172 359/630 |
| 2017/0248272 | A1 * | 8/2017 | Ullrich | F16P 3/14 |
| 2018/0304800 | A1 * | 10/2018 | Thompson | A41D 27/205 |
| 2019/0021411 | A1 * | 1/2019 | Chen | A41D 27/085 |
| 2019/0056315 | A1 * | 2/2019 | Kinrot | G01J 3/0291 |
| 2019/0384556 | A1 * | 12/2019 | De Backer | A41D 1/005 |
| 2020/0005605 | A1 * | 1/2020 | Jones | F21V 23/045 |
| 2020/0022428 | A1 * | 1/2020 | Lynch | A41D 27/085 |
| 2021/0052198 | A1 * | 2/2021 | Parvaneh | A61B 5/1117 |
| 2021/0153574 | A1 * | 5/2021 | Greszler | G08B 21/02 |
| 2024/0023643 | A1 * | 1/2024 | Asbeck | A41D 27/085 |
| 2024/0212407 | A1 * | 6/2024 | Baker | G07C 9/28 |

FOREIGN PATENT DOCUMENTS

| | | |
|---|---|---|
| DE | 102016224565 | 6/2018 |
| RU | 189212 | 5/2019 |
| WO | 2016/196483 | 12/2016 |
| WO | 2018/187432 | 10/2018 |
| WO | 2020/108996 | 6/2020 |

OTHER PUBLICATIONS

English translation of Written Opinion from corresponding PCT Appln. No. PCT/EP2021/054568, dated May 14, 2021.

* cited by examiner

ARTICLE OF CLOTHING CONFIGURED TO PROVIDE SIGNALS UPON OBJECT RECOGNITION

FIELD

The invention relates to an article of clothing with electronic, and to a method for manufacturing such an article of clothing.

BACKGROUND

Generic articles of clothing comprise, on the one hand, cut parts which are each cut to size from a fabric and are subsequently sewn together, and, on the other hand, at least one electronic component. Such generic articles of clothing are designed to meet an increasing need to add electronic functions to conventional articles of clothing. On the one hand, the article of clothing should be produced as cost-effectively as possible and should offer unrestricted wearing comfort, an attractive design and unrestricted robustness, particularly as concerns normal wear and washings, while on the other hand the electrical functions should provide functionality that goes beyond the conventional purpose of articles of clothing, namely the visually appealing covering of body parts. For example, tops for running clothes are known from the company Sensoria, to which a heart rate monitor is sewn that is accessible from the outside and via which the heart rate can be measured during a sporting activity and transmitted to a smartphone. Also known, for example, is a pair of running pants from the company Lumo Run, to the waistband of which a motion sensor is detachably attached, via which motion data can be determined during running and sent to a smartphone, for example, so that a runner can evaluate his motion data and improve his running behavior. Also known, for example, are articles of clothing in which heating elements are provided that can be switched on by a user as needed.

In particular, however, there is also a desire to add functionalities to articles of clothing that can be used to provide improved safety for the wearer of the article of clothing. For example, jackets are known on which signal lights are provided that can be switched on by a wearer of the jacket to make him more visible in the dark. Also known, for example, are shoes in which lights are integrated that light up in response to predefined movements of the shoe in order to improve the visibility of a wearer of the shoe. However, in the various approaches known in prior art, the electrical components integrated into the article of clothing to improve the visibility of a wearer of the article of clothing always have high energy consumption, which limits the useful life of the articles of clothing. Furthermore, the electrical components known in conventional articles of clothing do not provide improved protection of the wearer of the article of clothing.

SUMMARY

The present invention is based on the problem of providing an article of clothing, in particular a jacket, which at least partially eliminates one disadvantage of conventional articles of clothing.

The article of clothing according to the invention comprises a plurality of cut parts which are made of a fabric, in particular cut to size, and sewn together. Generally preferred, at least one of the cut parts, preferably the majority of the cut parts, in particular each of the cut parts, is a seamless coherent piece of fabric made from a fabric, such that the cut part is directly made in one piece from a fabric, in particular directly cut to size in one piece from a fabric, and is not made from a plurality of fabric parts cut to size and subsequently joined together. The article of clothing has as electronic components at least a sensor unit for detecting a presence of an external object, a control unit, and an electronic signal generator unit. Generally, in the present application, each component of the article of clothing is referred to as an electronic component of the article of clothing through which or to which electrical current flows during an intended use of the article of clothing in an operating phase of the article of clothing, preferably each of the electronic components being connected to the control unit, wherein a predefined current flow is provided between the control unit and the respective other electronic component in an operating phase of the article of clothing. For example, an electronic component can be designed as a conductive trace, a sensor, or a light source. In particular, some of the electronic components can comprise a plurality of electronic functional elements which are electrically conductively connected to each other in a functionally cooperating manner to form an electronic circuit which provides the function of the respective electronic components, whereas other electronic components can be single parts and very simple in design. According to the invention, one of the electronic components is designed as a sensor unit for detecting a presence of an external object. For this purpose, the sensor unit is designed to output measured values, wherein the sensor unit outputs a different measured value when it detects the presence of an external object than when it does not detect the presence of an external object. For this purpose, the sensor unit can be configured in various ways. For example, the sensor unit can be configured to detect a light source as an external object. For this purpose, for example, the sensor unit can have a photodiode, wherein the current output from the photodiode is output from the sensor unit as the measured value, wherein the current value changes in the presence of a light source that emits light to the photodiode. Depending on the intended application, the sensor unit can be tuned to light of a certain frequency, in particular to the detection of visible light in a frequency range of about 400 THz to 750 THz. Instead of or in addition to a photodiode, the control unit can comprise, for example, a CCD chip as a sensor. In one embodiment, the sensor unit can comprise at least one TOF (Time Of Flight) sensor that detects the presence of an external object by an external object approaching the article of clothing, since the time in which light emitted by the TOF sensor returns to the TOF sensor is shortened. For example, the sensor unit can also be designed as a conventional infrared motion detector or ultrasonic sensor. The signal generator unit is configured to output a signal that is perceptible to the wearer of the article of clothing and/or to output a signal that is perceptible to an external observer of the article of clothing. For example, the signal emitter unit can include a light source that emits light that is particularly perceptible to an external observer of the article of clothing. For example, the signal generator unit can comprise a sound generator unit that emits a signal tone, for example via a loudspeaker. For example, the signal generator unit can comprise a vibration device that outputs vibration signals as a perceptible signal. Particularly preferably, such a vibration unit is provided on the inner side of the article of clothing facing the wearer of the article of clothing, in particular on sensitive parts of the wearer's body, such as the wrist or in the shoulder or neck region, so that the wearer can perceive the vibration signal particularly well. According to the invention, the control unit is designed to receive measured values from the sensor unit during an operating phase of the article of clothing and to transmit control signals generated as a function of the read-out measured values to the signal generator unit. The signal generator unit is designed to output, upon receipt of a predefined control signal, a predefined signal that can be perceived by a wearer of the article of clothing and/or by an external observer of the article of clothing. In the article of clothing according to the invention, measured values are thus read out from the sensor unit via the control unit, and control signals are transmitted to the signal generator unit via the control unit in a targeted manner as a function of the read-out measured values, the signal generator unit preferably outputting predefined signals exclusively when predefined control signals are transmitted to it. These signals are then suitably configured to be perceptible to the wearer of the article of clothing or to the external observer.

The article of clothing according to the invention provides significant advantages over conventional articles of clothing. The inventors have recognized that an article of clothing can be particularly effective in protecting its wearer while at the same time consuming as little energy as possible if both a control unit and a sensor unit and a signal generator unit are integrated into the article of clothing, so that the signal generator unit selectively outputs signals when the sensor unit has outputted measured values that are classified as a potential hazard. Accordingly, the signal generator unit preferably outputs predefined signals, which are preferably perceptible to an external observer of the article of clothing and/or the wearer of the article of clothing, only when it has received a predefined control signal from the control unit, which is output to the signal generator unit via the control unit only when the measured values read out by the sensor unit have been evaluated in such a way that the presence of a hazard has been associated with them. The article of clothing according to the invention thus reacts specifically to a predefined presence of objects relevant to the particular area of application of the article of clothing. Energy consumption is thereby reduced, since the signal generator unit does not permanently consume energy, as is the case, for example, with conventional luminous jackets, by emitting signals even when there is no threat of danger. According to the invention, the control unit comprises at least one interface via which both the measured values of the sensor unit are read out and the control signals are transmitted to the signal generator unit. In one embodiment, the control unit comprises a computing unit in which the measured values read out by the sensor unit are evaluated and in which the control signals are generated as a function of the measured values and are then output to the signal generator unit. In one embodiment, the control unit is designed as an interface, in particular as a standardized interface, for example as a wired interface, in particular as a USB interface, or as a wireless interface, in particular NFC or Bluetooth interface, in particular Bluetooth smart, Bluetooth smart ready or Bluetooth low energy (BLE) interface, wherein during the operating phase an external computing unit is connected to the control unit and the measured values read out by the sensor unit are transmitted via the interface to the external computing unit, wherein in the external computing unit the measured values are evaluated and in dependence on the measured values control signals are generated which are transmitted via the interface and thus the control unit to the signal generator unit. In general, at least one of the electronic components is particularly preferably integrated in at least one cut part, so that the electronic component is non-detachably connected to the respective cut part or parts. In a particularly preferred embodiment, all of the electronic components are integrated in at least one of the cut parts, particularly in a selection of the cut parts. The electronic components of the article of clothing each have a volume defined by the geometric shape of the respective electronic component. Together, the volumes of all of the electronic components of the article of clothing form a total electronic component volume of the article of clothing. In one embodiment, a majority of the electronic components of the article of clothing are integrated into only one of the cut parts of the article of clothing, in particular at least 75% of the electronic components. Particularly preferably, these electronic components are fixed to at least 90%, in particular at least 95%, of their two-dimensional extent adjacent to the one cut part. In one embodiment, such a predominant majority of the electronic components of the article of clothing are integrated into only one of the cut parts of the article of clothing, so that at least 80% of the total electronic component volume is formed by the electronic components integrated into only one of the cut parts of the article of clothing. By integrating a majority, in particular all, of the electronic components into only one cut part, the manufacturing process can be particularly simplified and the durability or shelf life of the article of clothing can be improved.

The inventors have further recognized that in particularly advantageous embodiments of the article of clothing according to the invention, thanks to the design according to the invention, the article of clothing can have particularly advantageous properties that qualify it as a highly functional article of clothing. For example, a waterproof or at least water-repellent article of clothing, in particular a jacket, with the functional properties according to the invention can be realized by the embodiment according to the invention, which, for example, at least in a spray test according to standard DIN EN 24920, meets the requirements for a standardized grade of at least 3 (wetting of the sprayed surface only on small, separated areas), in particular of at least 4 (no wetting, only adhesion of small drops to the sprayed surface), in particular the best grade of 5 (no wetting and no adhesion of small drops to the sprayed surface).

In one embodiment, at least some of the electronic components are non-detachably bonded to the respective fabric from which the respective cut part is cut to size on which the respective electronic component is arranged. Preferably, at least some of the electronic components extend across several cut parts, being non-detachably bonded in the article of clothing to the respective fabric from which the respective cut part is cut to size. Here non-detachable connection is to be understood in such a way that detachment of the electronic component is possible only by damaging the article of clothing. Particularly preferably, at least the sensor unit and the signal generator unit are non-detachably connected to the respective fabric from which the respective cut part is cut to size. Particularly preferably, moreover, the control unit is also non-detachably connected to the respective fabric from which the respective cut part is cut to size. Particularly preferably, the control unit comprises an electrical interface, in particular a standard interface, in particular a wired or wireless interface. A wireless interface can generally preferably be designed, for example, as a Wifi interface or as a Bluetooth interface, in particular as a Bluetooth smart, Bluetooth smart ready or Bluetooth low energy (BLE) interface. Particularly preferably, the electronic components are at least partially printed onto the respective fabric, glued onto the respective fabric, embroidered into the respective fabric, knitted in or woven in. Particularly preferably, the electronic components comprise conductive yarns that are part of the respective fabric, for example by being glued, embroidered, knitted or woven into the respective fabric. By integrating the electronic components into the cut parts, the article of clothing can be particularly robust and easy to manufacture. In one embodiment, the article of clothing is manufactured by first sewing the cut parts together at least in sections and then integrating the electronic components into the cut parts, and particularly preferably, the cut parts together at least at such points before integrating the electronic components into the cut parts where the electronic components pass from the respective cut parts to the adjacent cut parts. In another embodiment, the electronic components are first integrated into the cut parts before the cut parts are then sewn together.

In one embodiment, the control unit comprises a link to a computing unit in which an evaluation logic is stored. The control unit is designed to evaluate the measured values read from the sensor unit with the stored evaluation logic and to output control signals to the signal generator unit as a function of an evaluation result obtained by the evaluation logic. In one embodiment, the control device comprises the computing unit. For example, the link can be stored via a communication interface, in particular wireless or wired, via which the control unit accesses programming stored on a device separate from the cutting parts. In general, the dependency is preferably predetermined or predeterminable. Preferably, the programming is stored on a mobile device comprising a GUI through which the dependency can be modified by a user. In one embodiment, the computing unit is integrated into the cut parts of the article of clothing, i.e. is non-detachably connected to the respective fabric from which the respective cut part is cut to size. In one embodiment, the article of clothing is a set comprising cut parts cut to size from a fabric, which are sewn together, and a separate computing unit, in which the evaluation logic is stored and which can be reversibly detachably connected, in particular via a communication interface, to the components of the electronic components integrated in the cut parts.

Particularly preferably, the electronic components are integrated in the article of clothing in such a way that, starting from any point at which the electronic components are located, the article of clothing can be reversibly bent and/or folded within a distance of less than 3 cm, in particular less than 2 cm, in particular less than 1 cm. The inventors have recognized that with this embodiment, the comfort of the article of clothing can be maintained in a particularly favorable manner For example, for this purpose, electrically conductive yarns can be used on the one hand for implementing the electronic components, and on the other hand prefabricated electronic components whose dimension is so small that the above-mentioned bendability and/or foldability is still ensured, these prefabricated electronic components being connected to the further components of the respective electronic component in a non-detachable manner, i.e. detachable only with destruction. In this context, the electronic components can also exhibit bendability and/or foldability in themselves. For example, a respective electronic component may have components that are hingedly connected to each other and each have a correspondingly small size, preferably of less than 3 cm in any direction, preferably of less than 2 cm in any direction. In one embodiment, at least one of the electronic components has at least one sequin formed as a circuit board equipped with electronic functional elements. The sequin may, for example, form the electronic component or be one of a plurality of components of the electrical component. It is known as standard that printed circuit boards are equipped with electronic functional elements. Standard electronic elements such as capacitors, transistors, conductive traces, coils, diodes, converter circuits, loudspeaker modules and/or transformers are used as electronic functional elements. The production of a printed circuit board is absolute industrial standard. For this purpose, a printed circuit board is equipped with the electronic functional elements. Preferably, the printed circuit board is rigid and thus not bendable and/or foldable. Foldable means, as is generally known, that an object which extends flatly can be folded at a folding line in such a way that two sections of its previously flat surface, which were previously arranged on two different sides of the folding line, lie on top of each other on the same side of the folding line. By forming the sequin as such a circuit board equipped with functional elements, the sequin simultaneously exhibits the mechanical properties necessary for attachment to an article of clothing and the electronic properties functionally necessary for its function as part of the electronic component. Preferably, the printed circuit board to which the electronic functional elements are directly attached forms the mechanical interfaces for attaching the sequin to the article of clothing. In particular, a sewing recess is provided as the mechanical interface, which is surrounded by a border, preferably in a circumferentially closed manner, so that it is formed as a sewing hole. Such a sewing recess enables the sequin to be attached to a cut part of the article of clothing in a very simple manner as customary for the manufacture of the article of clothing by means of a yarn. The sequin preferably has an extension of less than 3 cm, in particular less than 2 cm, in all directions. This ensures the described advantageous reversible bendability or foldability of the article of clothing in a particularly advantageous manner Contacts are provided on the sequin via which its electrical functional elements can be contacted. In the article of clothing, the sequin is connected via its contacts to a conductive yarn, which yarn is connected to at least one of the cut parts, to the cut part and is thus fixed to the cut part. The sequin has at least one sewing recess at the border of which one of the contacts is formed, the conductive yarn running through the sewing recess while applied against the border thereof and fixing the border of the sewing recess to the cut part. The conductive yarn, which is connected to the cut part, thus simultaneously ensures electrical contacting of the electronic functional elements of the sequin and mechanical fixing of the sequin to the cut part. In one embodiment, the article of clothing incorporates a plurality of sequins that are interconnected by the electrically conductive yarn under formation of an electronic circuit whose traces are formed at least in part by the electrically conductive yarn and whose electronic functional elements are formed by the sequins. Of course, the electrically conductive yarn may comprise a plurality of separate yarn sections, each made of a suitable yarn material. In this regard, each yarn section serves to provide a portion of the electrical traces of the electronic circuit. For example, the electronic circuit may form one of the electronic components or may form a plurality of the electronic components. Preferably, at least one of the electronic components comprises a group of sequins, each of which forms at least one electronic functional element of that electronic component and which are interconnected by the conductive yarn to form that electronic component. The functional elements of these sequins are thus the functional elements of the electronic component. The inventors have recognized that the use of sequins as described enables bendability and especially foldability, i.e. sharp folding of the article of clothing at points very close to one another, which is particularly advantageous for wearing comfort, and additionally simplifies and cheapens the manufacture of a highly functional article of clothing. This is because the sequins can be produced using a standard method for producing printed circuit boards with desired electronic functional elements, and can then be connected to one another via the conductive yarns, so that practically the cut parts constitute a higher-level printed circuit board, the conductive yarn forming the conductive traces arranged directly on this higher-level printed circuit board, and the sequins forming the electronic functional elements of this higher-level printed circuit board, which are connected to one another via the conductive yarn as their conductive traces. The implementation of the article of clothing according to the invention thus enables both the manufacture of sequins by means of standard manufacturing processes of conventional circuit boards and the standard application of the sequins by means of conventional sequin embroidery machines to a cut part, whereby complex electronic circuits can be integrated in the article of clothing in a simple manner without the article of clothing losing wearing comfort as a result. Particularly preferably, the at least one sequin has a waterproof enclosure in which the electronic functional elements of the sequin are encapsulated. Particularly preferably, this enclosure forms a completely enclosed interior space in which all the functional elements of the sequin are arranged, with the contacts being arranged outside the enclosure and a conductor trace extending from the contacts into the interior space. By providing the waterproof enclosure, washability of the article of clothing at 30 ° C. can be ensured without water being able to penetrate into the interior space enclosed by the enclosure and thus reach the functional elements, which ensures that all functions of the article of clothing are maintained in a particularly simple manner Particularly preferably, one side of the sequin is formed as a breakage side, which is formed as a broken edge. At its breakage side, the sequin has thus been broken off from an adjacent section previously attached to it. The formation of a breakage side is particularly advantageous, since this made it possible to hold the sequin over the previously adjacent section during a working step during which it was fixed to the cut part, which particularly simplifies the fixing of the sequin to the cut part, and because of the subsequent removal of this section, the dimensions of the sequin can be kept particularly small, which is ultimately particularly advantageous for the wearing comfort of the article of clothing. In one embodiment, the sequin has a first section formed as an electronics section and a second section formed as a guide section arranged next to the first section. The electronics section of the sequin has the at least one sewing recess, in particular all sewing recesses, via which the sequin is attached to the article of clothing, i.e. through which a yarn for attaching the sequin to the article of clothing passes, and the electronics section has all electronic functional elements of the sequin. The guide section has an area of at least 20 $mm^2$, in particular at least 30 $mm^2$, more particularly an area of 20 $mm^2$ to 50 $mm^2$. By providing the guide section which is independent of the electronic section, the sequin can be designed to be particularly specifically adapted to standard sequin embroidery machines, which particularly simplifies and especially accelerates the production of the article of clothing. By providing the electronics section independent of the guide section, this section can be specifically formed to provide the required electronic functionalities without regard to the mechanical engagement of a sequin embroidery machine. The guide section and the electronic section are arranged side by side and thus do not overlap. However, the electronic section and guide section are rigidly connected to each other so that the position of the electronic section is uniquely determined by the mechanical fixing of the guide section. Preferably, the guide section is arranged next to the electronics section in a predetermined direction, with the guide section and electronics section being delimited from each other by a boundary extending rectilinearly and perpendicularly to the predetermined direction. Particularly preferably, the electronic section and the guide section are integrally formed in one piece, and preferably the guide section is formed by the circuit board substrate material of the board as which the sequin is formed. Particularly preferably, a guide hole for a mandrel of a sequin embroidery machine is provided in the guide section. Such a mandrel is commonly provided in conventional sequin embroidery machines, which takes the sequins to be attached to a cut part by engaging a guide hole of the sequin, so that feeding of the sequin to the cut part and/or alignment of the sequin to the cut part is performed via this mandrel before and/or while the sequin is attached to the article of clothing by means of the sequin embroidery machine. The mandrel may, for example, be in the form of a pin or a wart of a wart wheel and is configured to engage the guide hole. The provision of such a guide hole, preferably with a diameter of 0.8 mm-2 mm, is particularly advantageous for the especially simple attachment of the sequin and thus favorable production of the article of clothing. Particularly preferably, the sequin is fixed to the cut part exclusively within its electronic section, so that the guide section does not serve to mechanically fix the sequin to the cut part but merely to position the sequin for fixing during the manufacture of the article of clothing.

In one embodiment, the article of clothing has an outer fabric layer that forms an outer surface of the article of clothing facing away from the wearer when the article of clothing is worn as intended. Preferably, the article of clothing further comprises a bottom fabric layer that forms an inner side of the article of clothing facing toward the wearer when the article of clothing is worn as intended. The bottom fabric layer is thus the innermost layer of the article of clothing, i.e. the layer of the article of clothing closest to the wearer. Particularly preferably, an intermediate space is formed between the outer fabric layer and the bottom fabric layer, in which the electronic components are arranged. Particularly preferably, the electronic components are arranged in this intermediate space over at least 90%, in particular at least 95%, of their two-dimensional extent. In one embodiment, the electronic components are arranged completely within this intermediate space. For example, the electronic components can be integrated for this purpose in an intermediate layer formed from one or more cut parts of the article of clothing, which intermediate layer is located in the intermediate space between the bottom fabric layer and the outer fabric layer. For example, this intermediate layer may be formed as a lining, insert, or membrane, so that the electronic components are integrated into the lining, insert, or membrane. In one embodiment, the article of clothing has an intermediate layer located in the space between the bottom fabric layer and the outer fabric layer, wherein the intermediate layer has only exactly one cut part, wherein a majority of the electronic components of the article of clothing, in particular at least 75% of the electronic components, are integrated in this cut part and thus arranged in the intermediate space. Preferably, at least 80% of the total electronic component volume formed by all electronic components of the article of clothing are formed by the electronic components integrated in this one cut part. By providing such a one-piece intermediate layer, the integration of the electronic components into the article of clothing can be particularly simplified and thus a correspondingly functional article of clothing can be particularly easily manufactured. Particularly preferably, the intermediate layer comprises precisely one cut part, the cut part being a seamless coherent piece of fabric which is directly produced in one piece from a fabric, in particular is directly cut to size in one piece from a fabric, the said electronic components integrated in the intermediate layer being integrated in this cut part. The cut part forms a supporting fabric and thus a type of printed circuit board for the electronic components. Preferably, during the manufacture of the article of clothing, the said intermediate layer, i.e. the one cut part with the electronic components integrated therein, is joined to or attached to the bottom fabric layer and/or the outer fabric layer after the cut parts from which the bottom fabric layer and the outer fabric layer are respectively made have been joined together, in particular sewn together, to create the bottom fabric layer and the outer fabric layer, respectively. The connection of the intermediate layer to the outer and/or bottom fabric layer can take place, for example, by sewing, gluing, pressing and/or riveting. The precisely one cut part of the intermediate layer, which is preferably a seamless coherent piece of fabric made of one material, can be designed in any geometry without having to take into account the design of the article of clothing, since it is arranged between the outer fabric layer and the bottom fabric layer. For example, the article of clothing is a jacket in which, when the intermediate layer is formed by precisely one cut part, said precisely one cut part of the intermediate layer extends along a cut part of the outer fabric layer which forms a part of a sleeve of the jacket and/or extends along a cut part of the outer fabric layer which forms a part of the back of the jacket and/or extends along a cut part of the outer fabric layer which forms a part of the front of the jacket and/or extends along a plurality of different cut parts of the outer fabric layer which each form a part of a different one of the two sleeves of the jacket. The definition that the intermediate layer extends along a cut part of the outer fabric layer of course also comprises that the intermediate layer extends along partial regions of a cut part or along partial regions of several cut parts of the outer fabric layer. In general, the provision of the intermediate layer integrating electronic components and extending along a plurality of different portions of the outer fabric layer, each forming a portion of a respective different part of the jacket, for example, the sleeve and the back region or the back and the front region or the sleeve and the front region or the sleeve and the back region or the front and the back region, whereby it can always be advantageous if the intermediate layer is provided on both sleeves, which provides for a high functionality of the jacket in a simple way, since different parts of the jacket can be provided with the electronic components there and thus with corresponding functions. In this context, the one or more cut part of the intermediate layer can have a smaller two-dimensional extent than all cut parts of the outer fabric layer, in particular less than 70% of the two-dimensional extent of the outer fabric layer, and the intermediate layer can in particular have a geometric form independent of the outer appearance of the jacket, wherein this form can be functionally adapted to the purpose of the intermediate layer to act as a substrate for said electronic components. By integrating a majority of the electronic components, in particular a vast majority of the electronic components, in the intermediate layer, the manufacturing process of the article of clothing can be particularly simplified, which can particularly simplify the application of the electronic components to the cut part. For example, the electronic components integrated in the intermediate layer can be formed, at least in part, by sequins, each of which is formed as a circuit board equipped with functional elements. These sequins can be attached to the cut part in conventional manufacturing equipment and thus integrated into this cut part, for example, by conventional sequin embroidery machines, by embroidery machines in which the sequins for the embroidering process are passed through a tube to a desired location on the cut part or the sequins are guided in the form of a sequin ribbon to a desired location on the cut part by a sequin ribbon feed device, or by sequin embroidery machines in which the sequins are guided to a desired location on the cut part via a mandrel which is designed, for example, in the manner of a pin or as a wart of a wart wheel. In particular, such sequins can be designed or attached to the cut part as explained above. In particularly preferred embodiments, the article of clothing has several intermediate layers, one of the intermediate layers being the intermediate layer in which the majority of the electronic components explained above are integrated, and at least one other of the intermediate layers performing a different function, such as the function of a lining or the like. In one embodiment, the electronic components are arranged on the side of the bottom fabric layer facing the outer fabric layer and/or on the side of the outer fabric layer facing the bottom fabric layer. In any case, arranging the electronic components in the intermediate space has the particular advantage that the electronic components are particularly well protected. Particularly preferably, only those sections of the electronic components are located outside the intermediate space which are electrically insulated and sealed in a waterproof manner in an active state of the article of clothing. For example, only one electronic component having only one cable connection means may extend out of the intermediate space, the article of clothing preferably having means suitable for insulating and sealing the cable interface.

In one embodiment, the sensor unit comprises at least one optical sensor configured to output a measured value as a function of a light intensity of light incident thereon. In one embodiment, the sensor is configured to output a binary measured value, wherein the sensor is configured to output a first signal when a minimum light intensity is exceeded and to output a second signal when the light intensity incident thereon falls below the minimum light intensity. In one embodiment, the sensor is designed to output a measured value that changes continuously as a function of the light intensity. For example, the sensor may be configured as a photodiode, wherein the sensor outputs a photocurrent as a measured value as a function of the light intensity. Particularly preferably, the control unit is designed to control the signal generator unit to output a signal as a function of the value of the light intensity output as a measured value. For example, the control unit can be designed to output a predefined control signal to the signal generator unit as soon as a predetermined value of the light intensity is reached, which it can assign to the measured value output by the sensor unit. It is generally preferred that a link to a evaluation unit is stored in control unit, which evaluation unit performs the corresponding evaluation of the measured value and thus defines the dependency with which it is determined which signal the signal generator unit outputs in response to a specific measured value output by the sensor. Particularly preferably, the dependency is defined or can be defined in such a way that if the value of the light intensity changes by more than a limit value, the signal generator unit is triggered to output the signal. In this particularly advantageous embodiment, the control unit is thus designed in such a way that it continuously receives measured values from the optical sensor and only triggers the signal generator unit to output the signal if the measured value, to which a specific value of the light intensity can be assigned, changes by more than a limit value. This has the particular advantage that background noise, i.e. background illumination in the present case, is effectively suppressed during evaluation. Thus, the article of clothing can detect when a light source occurs that produces illumination on the optical sensor, so that the total light intensity incident on the sensor, which is the result of the ambient light and the additional light source, increases. Accordingly, the particularly advantageous embodiment of the article of clothing can reliably detect when a light source approaches or illuminates the article of clothing. This can be particularly advantageous for detecting the approaching of a luminous object, such as a car, in the dark.

Particularly preferably, the sensor unit forms a sensor surface, wherein at least 80%, in particular at least 90%, of the sensor surface are arranged in an area on the article of clothing whose outwardly facing surface normal has an angle of at least 30°, in particular at least 45°, to the vertical when worn as intended, the vertical being defined by the direction of the weight force acting on the earth. In wearing the article of clothing as intended, the focus is on the fact that a wearer of the article of clothing stands up straight, i.e. stands along a vertical line parallel to the weight force acting on the earth, with his arms hanging straight down along the vertical line and his eyes directed to the horizontal line. It should be taken into account that the article of clothing is, of course, intended to be worn in a predetermined manner by a healthy wearer, in particular a human being, which is the basis for the definition of "wearing as intended" in the present case. Particularly preferably, the sensor surface is the surface of the sensor unit via which the sensor unit can receive signals from the environment around the article of clothing, so that the sensor unit outputs measured values that relate exclusively to the influences the sensor unit is exposed to at its sensor surface. In particular, the sensor surface can be formed by discrete, spaced-apart sensors of the sensor unit. The orientation of the sensor surface particularly advantageously ensures that the sensor unit experiences as little interference as possible from objects that are not relevant to the safety of a wearer of the article of clothing. The inventors have recognized that, as a rule, dangerous objects approach the wearer of an article of clothing exclusively in a direction substantially perpendicular to the weight force. The orientation of the sensor surface can be particularly effective in avoiding interfering influences, for example interfering influences from street lamps when an optical sensor unit is provided.

In a particularly preferred embodiment, the article of clothing is in the form of a jacket. In this particularly preferred embodiment, the sensor unit preferably forms a sensor surface via which the sensor unit can pick up influences from the environment as explained, in particular via which exclusively the sensor unit can pick up influences from the environment as explained. Particularly preferably, the sensor area is limited to an area of the jacket that is spaced at least 2%, in particular at least 3%, in particular at least 5%, in particular at least 10%, from the lower end of the jacket when worn as intended. Particularly preferably, the jacket has on each side a side seam extending downwardly from the sleeve base, which side seam is concealed by the sleeve when worn as intended, the jacket having a waist circumference, the sensor area being spaced from the respective side seam by at least 3%, in particular at least 4%, in particular at least 6%, in particular at least 10% of the waist circumference. In this particularly preferred embodiment of a jacket according to the invention, it is particularly reliably ensured that a usual movement of a wearer of the jacket is not interpreted by the control unit as meaning that an external object is approaching, and that an approaching object is in fact detected.

In one embodiment, the signal generator unit has a power consumption of 500 mA to 3000 mA when outputting the signal to be output upon receiving the predefined control signal. Thus, because of the particularly advantageous property of the article of clothing according to the invention of only selectively outputting signals in response to the detected presence of an external object, the signal output unit can have a correspondingly high power consumption when outputting the signal, without disproportionately limiting the useful life of the article of clothing. Particularly preferably, the article of clothing has an energy storage device, wherein, when the signal is continuously output by the signal output unit, the energy storage device ensures a minimum operating time of three hours, in particular five hours. Generally, in one embodiment, the energy storage device is integrated into the article of clothing, in particular into the fabric(s) of the article of clothing from which the cut parts are made. Particularly preferably, the energy storage device is one of the electronic components of the article of clothing. In one embodiment, an energy supply interface is provided that is connectable to a conventional energy storage device, for example a smartphone or a power bank, for example a USB interface, so that the signal generator unit, the sensor unit and the control unit receive their electrical energy via this energy supply interface in the operating phase. In one embodiment, the power supply interface is also the interface of the control unit via which the measured values are read out from the sensor unit and the control signals are transmitted to the signal generator unit. Particularly preferably, the energy supply interface is provided in an inner pocket of the article of clothing so that it opens into the inner pocket of the article of clothing. Particularly preferably, the energy supply interface is a wireless interface, in particular an inductive interface.

In one embodiment, the control unit is configured to determine from measured values of the sensor unit whether fog is present in an environment around the article of clothing, the control unit being configured to permanently trigger the signal generator unit to output the signal in the event that fog is determined in the environment. Particularly preferably, the signal is a light signal and the signal generator unit comprises a light source. For example, the detection of fog can be ensured by providing a CCD chip as a sensor of the sensor unit and providing a corresponding evaluation logic. The described embodiment has the particular advantage that the article of clothing autonomously determines that the detection of external objects is difficult and then controls the signal generator unit to output the signal independently of the detection of a presence of an external object.

In one embodiment, the article of clothing comprises a motion sensor, wherein the control unit is configured to read measured values from the motion sensor and to determine from a change in a measured value output by the motion sensor within a predetermined time whether the wearer of the article of clothing has fallen, wherein the control unit is configured to generate an emergency signal when a fall of the wearer is determined. The control unit thus automatically determines on the basis of the measured values output from the motion sensor whether the wearer of the article of clothing has fallen. For example, an evaluation logic or a link to an evaluation logic can be provided in the control unit for this purpose, which interprets this movement as a fall in the event of a sufficiently jerky movement. When the measured values are interpreted as an indication of a fall, the control unit generates an emergency call signal. In one embodiment, the control unit generates an emergency call signal by controlling the signal generator unit to output a loud beep. In one embodiment, the control unit generates an emergency call signal by the control unit sending a command to a mobile radio device to dial an emergency call via a predetermined emergency call number. In this particularly preferred embodiment, the article of clothing is configured to be coupled to an external mobile radio device, in particular a smartphone, in the operating phase, for example via a wireless interface or via a USB interface, or the article of clothing has an integrated mobile radio device. In this embodiment, a program cooperating with the control unit is stored in the mobile radio device, which makes the emergency call. Particularly preferably, a telephone number to be dialed in the event of an emergency call can be stored in the program or in the control unit. Particularly preferably, the article of clothing further comprises a camera, wherein upon detection of a fall, the camera is controlled to take a photo which is transmitted directly to a predetermined address along with the emergency call. Preferably, the camera is provided by a sensor of the sensor unit.

In one embodiment, the article of clothing has a central switch that is integrated in particular into the fabric or fabrics from which the cut parts are cut. The wearer can use the switch to turn on and off at least one function of the electronic components of the article of clothing. Particularly preferably, the wearer can switch all of the electronic components of the article of clothing on and off via the switch. Accordingly, the wearer can thus determine via said switch whether or not the article of clothing is in the previously described operating phase. When the electronic components are deactivated, the article of clothing is no longer in the operating phase. In a particularly advantageous embodiment, the electronic switch is designed as a touch switch that can be actuated from the outside of the article of clothing by touch. Particularly preferably, the switch is designed as a capacitive switch or as a resistive switch. Particularly preferably, the article of clothing is formed as a jacket, wherein the switch is integrated in a sleeve of the jacket, in particular on an underarm part thereof. Particularly preferably, the switch is integrated in the sleeve of the jacket at a location that faces outwardly away from the wearer when worn as intended. In general, the switch is particularly preferably integrated into the article of clothing at a location that is visually identified on the outside of the article of clothing, the switch itself preferably not being located on the outwardly facing surface of the article of clothing but can be triggered merely by touching the identified area.

In one embodiment, the signal generator unit has a plurality of light sources distributed over the article of clothing. Particularly preferably, a light guide is connected to at least some, in particular the majority, in particular all of the light sources. Particularly preferably, the light guide is designed to ensure the emission of light over an area of more than 10 mm2, preferably with exactly one LED connected to the light guide for emitting light into said light guide. Preferably, at least one of the light guides is designed in a rod-like manner, with an elongated side being designed as a light output side, wherein preferably exactly one light source, in particular LED, is arranged at one end of the rod-like light guide and radiates light into the light guide in the illuminated state. In one embodiment, the light sources are connected to an outer side of the article of clothing via an at least partially transparent intermediate layer. The outer side of the article of clothing is thereby preferably formed by the outer fabric layer of the article of clothing as explained above. By providing the transparent intermediate layer, the light sources are particularly advantageously protected against external influences. Particularly preferably, the light guides form a portion of the outer surface of the article of clothing, and particularly preferably, each light source is protected from external influences by a light guide associated therewith. Particularly preferably, the light sources and especially the light guides are arranged distributed on the article of clothing in such a way that, when the article of clothing is worn as intended, light is emitted in each direction perpendicular to the vertical when the signal is output by the signal generator unit, so that, at a distance of at least 5 m from the article of clothing along each direction perpendicular to the vertical when the signal is output by the signal generator unit, a light intensity emitted by the light sources of the signal generator unit can be measured at the vertical height of the article of clothing. Particularly preferably, at least two light sources, in particular at least three light sources, in particular four light sources, are arranged at a front side of the article of clothing facing forward when the article of clothing is worn as intended and at a rear side of the article of clothing facing rearward when the article of clothing is worn as intended.

In one embodiment, the signal generator is configured to output a pulsed signal as the signal output on receipt of a predefined control signal, wherein the pulse rate is less than one third, in particular less than one fifth. The signal generator unit is thus designed in interaction with the control unit in such a manner that when the signal to be output is transmitted, the signal is transmitted in each case only as one signal pulse, with the signal pulse being followed by a rest period in which no signal is transmitted, after which a new signal pulse is transmitted. The signal pulse and the subsequent rest period form a period of the pulsed signal. The pulse rate designates the time share that the pulsed signal has in the entire period. By emitting a pulsed signal through the signal generator unit, the energy consumption may be particularly low, and furthermore, the article of clothing may thereby be particularly easily perceived. Furthermore, it is generally preferred that the signal generator is designed to output as a signal output on receipt of a predefined control signal, a signal, in particular a pulsed signal or continuous signal with a fixed or fixable total signal time (in the case of a pulsed signal, the rest periods between the pulses count) of at least ten seconds, in particular at least fifteen seconds.

In one embodiment, the electronic components are integrated into the article of clothing such that the article of clothing is washable at 30° C. Preferably, washing instructions are provided on the article of clothing, wherein the article of clothing is washable at 30° C. according to the washing instructions. Preferably, the article of clothing is machine washable at 30° C. The skilled person is aware of appropriate measures to ensure such machine washability of the article of clothing. For example, plastic encapsulations of components of the electronic components can be made for this purpose and/or a waterproof intermediate space can be provided in which the electronic components are arranged. In one embodiment, the article of clothing has an energy storage device that is to be separated from the other electronic components prior to the wash cycle. In another embodiment, the energy storage device is integrated into the article of clothing and remains connected to the other electronic components during the washing cycle, with suitable measures, in particular one of the suitable measures explained, being provided to protect the electronic components.

In general, the control unit particularly preferably comprises an interface for coupling a mobile electronic device. The mobile electronic device may be, for example, a mobile telephone, in particular a smartphone, an energy storage device or an MP3 player. Particularly preferably, the interface is designed as a wireless interface, in particular as an NFC interface. Particularly preferably, the interface is designed as a data exchange interface via which data can be transmitted both from the control unit to the mobile electronic device and from the mobile electronic device to the control unit. Particularly preferably, the article of clothing has an operating device via which the mobile electronic device can be operated in an operating phase in which the mobile electronic device is coupled to the control unit via the interface. The operating device is preferably designed as a resistive or capacitive operating device and can in particular also comprise a display, in particular an OLED display. In one embodiment, the article of clothing is designed as a jacket, wherein the operating device is arranged on a sleeve of the jacket, in particular on an underarm portion of the sleeve of the jacket, and is accessible from the outside of the jacket. In general, the article of clothing particularly preferably has communication means, in particular a microphone or headphones, which are connectable to the mobile electronic device via the interface. Particularly preferably, the article of clothing is designed to prevent data traffic between the communication means and the mobile electronic device when the signal generator unit is triggered to output a signal. This has the particular advantage that in the case of detecting a presence of an external object, the attention of the wearer of the article of clothing is not distracted by communication influences received via the mobile electronic device.

In one embodiment, the article of clothing is in the form of a jacket. A jacket standardly comprises a back, a front and two sleeves. Preferably, the sensor unit extends at least partially across the back and the front. Particularly preferably, the sensor unit further extends over the sleeves. Particularly preferably, the signal generator unit extends at least partially over the back and the front. Particularly preferably, the signal generator unit furthermore extends over at least one of the sleeves. Particularly preferably, the signal generator unit is configured to output a mechanical signal to the wearer, wherein the signal generator unit extends on at least one sleeve or on at least one shoulder or in the collar region of the jacket. Providing the signal generator unit, which outputs a mechanical signal to the wearer, at the sleeve and/or shoulder and/or collar area has proven to be particularly advantageous, since a wearer is usually particularly sensitive at these locations. Particularly preferably, for outputting the mechanical signal, the signal generator unit is arranged at such points of the jacket which are in close contact with the wearer when worn as intended. For example, the signal generator unit can be designed as a vibration unit in sections in which it is designed to output a mechanical signal.

The invention further relates to a method for manufacturing an article of clothing according to the invention. In the method according to the invention, a plurality of cut parts each cut to size from a fabric are sewn together, wherein a plurality of electronic components are integrated into at least one of the cut parts, i.e. are non-detachably connected to the respective cut part. In the process according to the invention, in order to create an electronic component integrated in one of the cut parts, a sequin is fixed to the cut part by means of a sequin embroidery machine, which sequin is formed as a circuit board equipped with electronic functional elements and comprises an electronics section and a guide section rigidly connected to this electronics section, the electronics section including all the electronic functional elements of the sequin. During the working step, the sequin embroidery machine grips the sequins at its guide section by means of a guide device. For example, the guide device comprises a mandrel that engages a guide hole provided in the guide section for gripping the sequin at its guide section. For example, the guide means may alternatively or additionally comprise a gripping means for gripping the guide portion laterally. In one embodiment, the guide device grips the guide section exclusively with the mandrel. By gripping the guide section, the guide device is enabled to position the guide section and thus the entire sequin. Gripping thus entails mechanical fixation of the sequin to the guide device via its guide section. With the guide device, the sequin embroidery machine guides the sequin into a predetermined position relative to the cut part. Subsequently, i.e. after implementation of the predetermined position, the sequin embroidery machine fixes the sequin to the cut part by means of an electrically conductive yarn which it passes through at least one sewing recess provided in the electronics section. By passing the conductive yarn through the sewing recess and applying the electrically conductive yarn to the border of the recess, a mechanical fixation of the sequin within its electronics section to the cut part is ensured, since the electrically conductive yarn thereby fixes a relative position of the sequin to the cut part within its electronics section, as is the case in conventional embroidery processes. Subsequently, preferably by means of the sequin embroidery machine, further sequins are mechanically fixed to the cut part with the electrically conductive yarn, and each of the sequins can be configured as described above for various embodiments and thus may, for example, comprise electronic functional elements, an electronics section and a guide section. By fixing both the first-mentioned sequin and the further sequins to the cut part by means of the electrically conductive yarn, the mechanical fixing of these sequins also results in an electrically conductive contacting of the sequins with each other, so that by means of the electrically conductive yarn the sequins are electrically conductively connected to each other and thus the functional elements encompassed by them are also electrically conductively connected to each other, so that by fixing the sequins to the cut part by means of the electrically conductive yarn, an electronic circuit is produced whose conductive traces are formed at least partially by the electrically conductive yarn and whose functional elements are formed by the sequins. Particularly preferably, after the electronics section has been mechanically fixed, the guide section is broken off from it and removed from the cut part, so that an article of clothing is produced which is free from the guide sections of the sequins.

The invention further relates to a set of sequins for creating an article of clothing according to the invention. Each of the sequins has a first section formed as an electronics section and a second section formed as a guide section disposed adjacent to the first section. The electronics section of the sequin has at least one sewing recess and includes all of the electronic functional elements of the sequin. The guide section has an area of at least 20 $mm^2$.

Particularly preferably, the guide sections of all the sequins of the set are identically formed, the set having a plurality of different sequins which all differ from one another in the design of their electronics section. Each of these different sequins thus has an electronics section that differs from the electronics sections of all other sequins of this plurality of different sequins. Particularly preferably, the electronics sections of the different sequins each have a different group of electronic functional elements. Preferably, the electronics sections of the different sequins are distinguished solely by the electronic functional elements provided thereon. A group of electronic functional elements comprises at least one electronic functional element in each case. Particularly preferably, the electronics sections of the different sequins each have an identical arrangement of sewing recesses. For example, a first sequin may comprise a light source as an electronic functional element, a second sequin may comprise a microcontroller as an electronic functional element, and a third sequin may comprise a sensor element as an electronic functional element. The set according to the invention enables a particularly inexpensive and simple creation of an article of clothing, which at the same time ensures a high wearing comfort and in which a complex electronic circuit for implementing elaborate functions of the article of clothing can be included. An electronic kit is provided by the set of different sequins, wherein the sequins allow easy fixation and electrical contacting to a cut piece by their guide section and enable the provision of a desired electronic function by their electronics section. The set according to the invention and the method according to the invention may each have features that are apparent to the skilled person from the above explanations of embodiments of the article of clothing according to the invention, but may also be used independently of the article of clothing according to the invention to implement an electronic function on a fabric.

The invention further relates to a method for controlling a signal generator unit integrated in an article of clothing. In the method according to the invention, measured values are read from a sensor unit integrated in the article of clothing and evaluated. Depending on an evaluation of the measured values, a predefined control signal is output, which is used to control the signal generator unit to output a signal assigned to the predefined control signal. The method according to the invention may include further features which are apparent from the above explanation of various embodiments of an article of clothing according to the invention. The invention further relates to the use of an article of clothing according to the invention and, in particular, to a computing unit for carrying out the method according to the invention. The use may comprise features which are apparent from the above explanations of embodiments of an article of clothing according to the invention and a method according to the invention.

BRIEF DESCRIPTION OF THE DRAWINGS

Exemplary embodiments of the invention will be described in more detail below with reference to three drawing figures. It is shown by.

DETAILED DESCRIPTION

Figure 1:
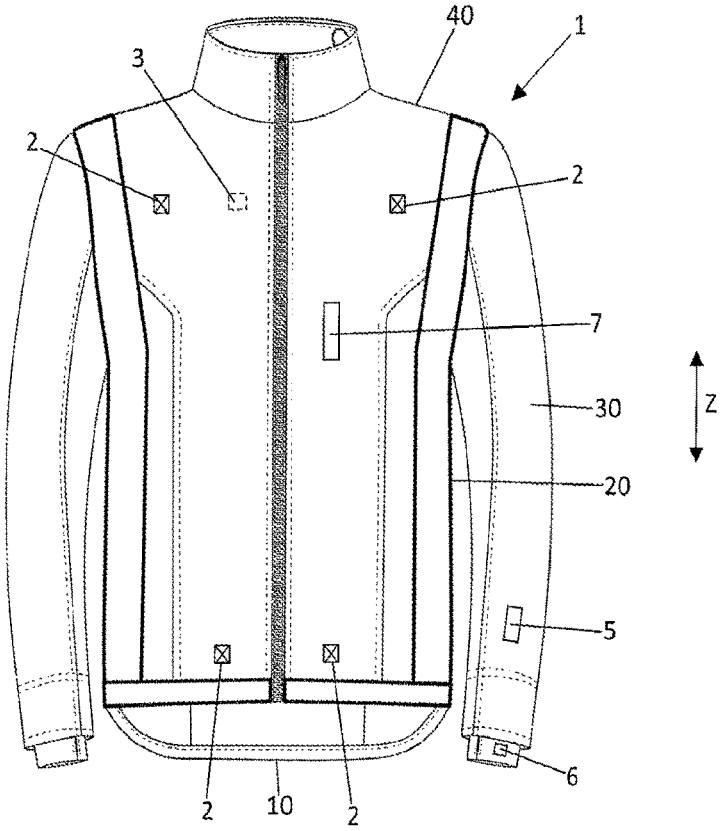
FIG. 1 is a view of a front side of an embodiment of an article of clothing according to the invention, in a schematic diagram.
Figure 2:
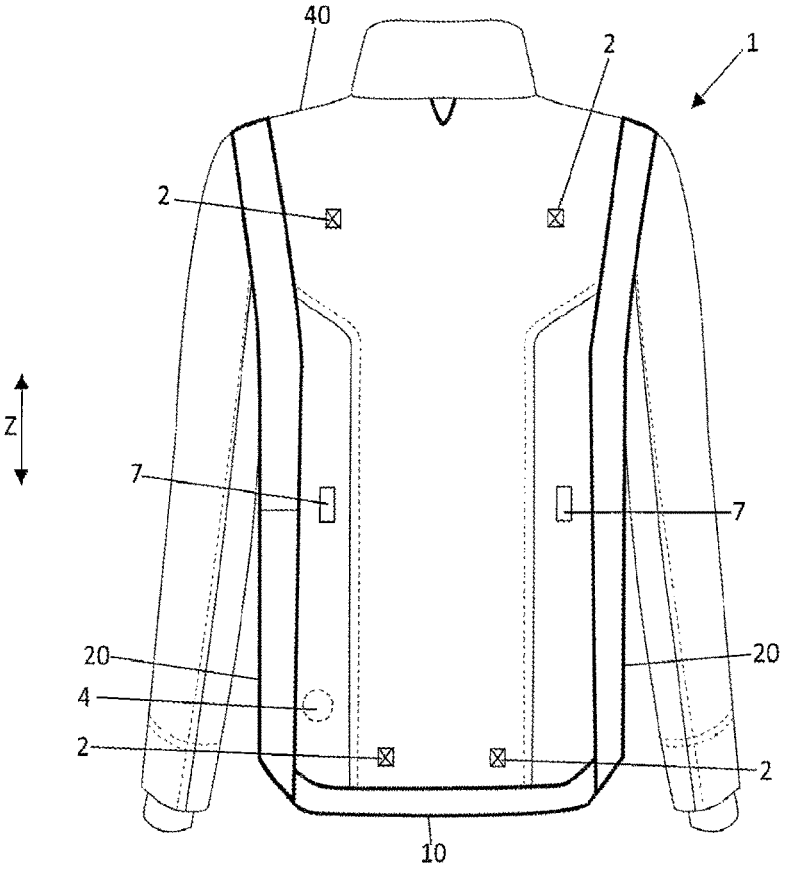
FIG. 2 is a view of a rear side of an embodiment according to FIG. 1, in a schematic diagram.

FIGS. 1 and 2 schematically illustrate one embodiment of an article of clothing according to the invention, which is in the form of a jacket 1. FIG. 1 shows the front side 100, FIG. 2 the back side 200 of this jacket 1. FIGS. 1 and 2 will be described together below.

The jacket 1 according to the invention has an outer fabric layer, a bottom fabric layer, and an intermediate layer. All layers are made of cut parts cut to size, which are sewn together. The jacket 1 has two sleeves 30 and extends vertically upward from a bottom end 10 along the vertical. At its upper end, the jacket 1 has shoulders 40. In the described embodiment, the jacket 1 comprises a signal generator unit 2, 6, which has, on the one hand, light emitter units 2, each comprising an LED and a light guide, and a vibration unit 6. All elements of the signal generator unit 2, 6 are electrically conductively connected to the control unit 4 of the jacket 1. The control unit 4 has an interface via which the control unit 4 can transmit control signals to all elements of the signal generator unit 2, 6. The jacket 1 also has a sensor unit, which in the present embodiment is formed by optical sensors 7, each of which is in the form of a CCD chip. In the present embodiment, four light emitter units 2 of the signal generator unit 2, 6 are respectively provided on the front and back 100, 200 of the jacket 1 and are distributed and aligned in such a way that, at a distance of 5 m from the jacket 1, light emitted by the light emitter units 2 is visible from any viewing direction perpendicular to the vertical Z, as long as the viewer is at the same level with the jacket 1 along the vertical Z. Also connected to the control unit 4 of the jacket 1 are all the sensors 7 of the sensor unit. Two of the sensors 7 are provided on the back 200 and one on the front 100 of the jacket 1. Connected to the control unit 4 is a motion sensor 3, a touch switch 5, and the vibration unit 6 of the signal generator unit 2, 6.

The jacket 1 can be set to its operation phase or from its operation phase to its rest phase by the touch switch 5. The touch switch 5 is a capacitive touch switch 5. When the jacket 1 is in its operating phase, the control unit 4 continuously reads measured values from the sensor unit and evaluates them. An evaluation logic is stored in the control unit 4, and the control unit 4 sends control signals to both the light emitter units 2 and the vibration unit 6 of the signal generator unit 2, 6 if the evaluation shows that the light intensity incident on at least one of the optical sensors 7 of the sensor unit increases by at least 50% from the previously determined measured value within in one second. In the present case, the control signals cause the light emitter units 2 to emit pulsed light at a pulse rate of one tenth, each being supplied with a current of 150 mA during the light pulse, and further, the control signals cause the vibration unit 6 to generate a vibration signal. Since the vibration unit 6 is located at a sleeve portion which is in close contact with the wearer when worn as intended, in the jacket according to the invention, when the presence of an external light source, which is equated with the presence of an external object in the present case, is detected as explained, both the wearer is warned by the signal emitter units 2, 6 and the approaching light-generating external object is warned. This is because the light emitter units 2 emit a perceptible light signal to the outside for the external object, i.e. for an external observer, and the vibration unit 6 emits a perceptible signal to the wearer.

It is further apparent from FIGS. 1 and 2 that the sensor unit is exposed to influences of the environment exclusively via such a sensor surface, namely via the surface formed by the optical sensors 7, which are sufficiently spaced from the side seams 20 and also from the lower end 10 of the jacket 1. This avoids that the functionality or detection rate of the sensor unit is reduced during various usual movements of a wearer when the jacket is worn as intended.

The illustrated embodiment of a jacket 1 according to the invention further comprises a motion sensor 3, which is also connected to the control unit 4. The control unit 4 continuously reads the motion sensor 3. Upon detection of a motion sequence of the motion sensor 3, which is defined as a fall in the evaluation logic of the control unit 4, the control unit 4 controls the sensor unit to take photos via its optical sensors 7. The control unit 4 further has a wireless Bluetooth interface through which it can be coupled to a smartphone. When a fall is detected by the control unit 4, the control unit 4 transmits the photos to the coupled smartphone and sends these photos to a predetermined address and triggers an emergency call to a predetermined emergency call number. The address and the emergency call number can be preset via wireless programming of the control unit 4 or via an App stored in the smartphone.

Figure 3:
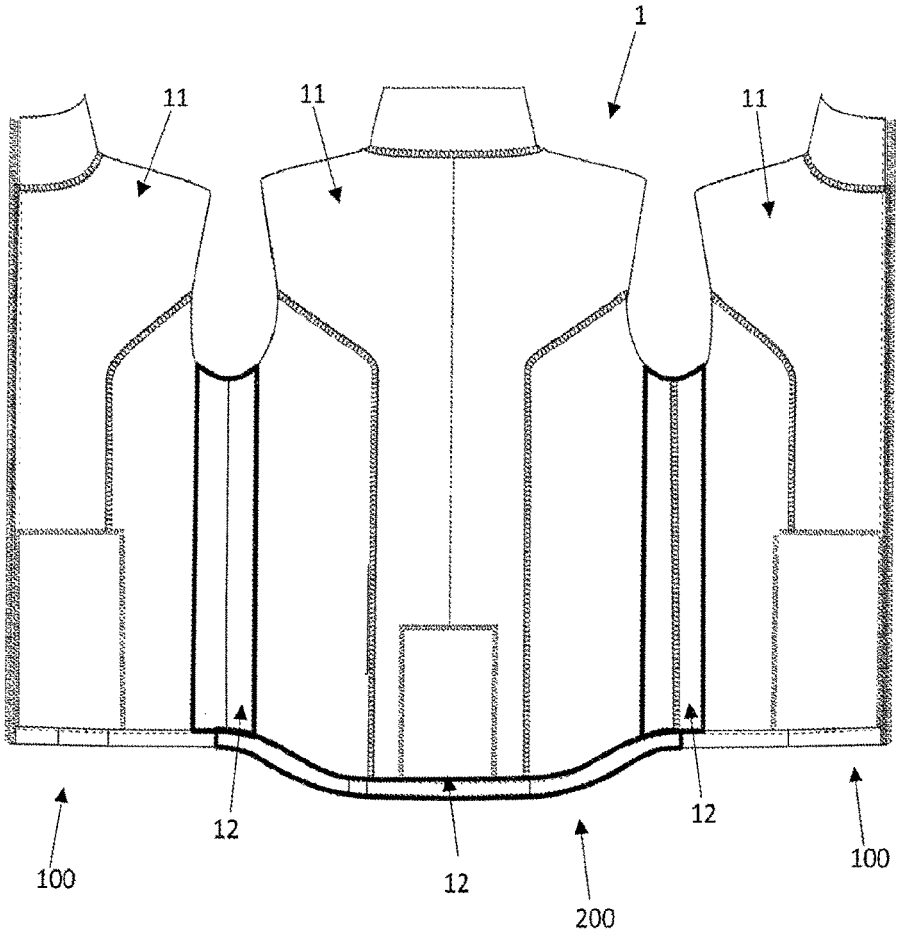
FIG. 3 is a cut pattern of a further embodiment according to the invention, in a schematic diagram.

FIG. 3 schematically shows the cut pattern of an embodiment according to the invention. The cut pattern shown in FIG. 3 is intended to illustrate in which areas of an embodiment of an article of clothing according to the invention sensors 7 of the sensor unit are preferably arranged, so that these sensors 7 can preferably fulfill their function without malfunctions during intended use of the article of clothing. The cut pattern shown in FIG. 3 is a pattern for a jacket 1. In FIG. 3 it can be seen that the jacket 1 has a front side 100 and a back side 200. In FIG. 3, sensor-free regions 12 of the jacket 1 are drawn with bold lines, as are sensor regions 11. The sensor-free regions 12 extend in the vicinity of the side seam 20 and at the lower end 10 of the jacket 1, whereas the sensor regions 11, where sensors 7 of the sensor unit are preferably placed, extend over the further flat extent of the jacket 1. From the described embodiment it is evident that when the sensor area of the sensor unit is arranged in a targeted manner, it can be deliberately avoided that the functionality of the sensor unit is inappropriately restricted while an article of clothing according to the invention is worn and used as intended.

Figure 4:
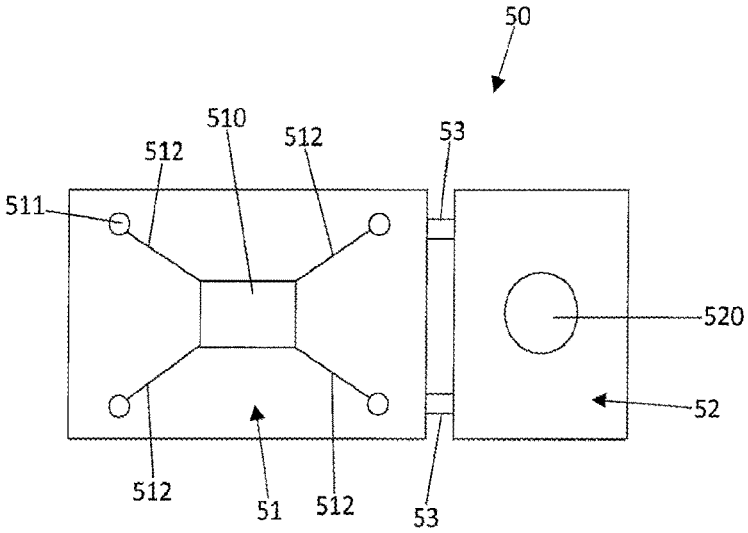
FIG. 4 is a sequin of an embodiment of an article of clothing according to the invention, in a schematic diagram.

In FIG. 4, a sequin 50 of one embodiment of an article of clothing 1 according to the invention is shown in a schematic diagram. The sequin 50 comprises an electronics section 51 and a guide section 52 arranged in an intended direction adjacent to the electronics section 51. The electronics section 51 is rigidly connected to the guide section 52 via webs 53. In the described embodiment, and generally advantageously, the electronics section 51 and the guide section 52 are integrally formed in one piece from a board substrate material. While the guide section 52 is free of electronic functional elements, the electronics section 51 has conductive traces 512 and a microprocessor 510 as electronic functional elements. The electronics section 51 also has sewing recesses 511, which are formed as sewing holes in the present case. These sewing recesses 511 are bounded by an electrically conductive border, each of which is electrically conductively connected to a section of a conductor trace 512 and forms a contact of the sequin 50. Accordingly, by fixing the electronics section 51 by means of an electrically conductive yarn running through its sewing recesses 511 and abutting the border thereof, mechanical fixing of the electronics section 51 to a cut part and electrical contacting can be performed simultaneously. The guide section 52 has a guide hole 520 for a mandrel of a sequin embroidery machine. In a manufacturing method according to the invention, the sequin 50 is gripped by the mandrel of the sequin embroidery machine by arranging the mandrel in the guide hole 520, and then aligned relative to a cut part, whereupon a fixation and thus also a direct electrical contacting of the electronics section 51 at the cut part are effected. Subsequently, the guide section 52 is broken off from the electronics section 51 at the webs 53. In the embodiment described and generally advantageously, according to the invention, a predetermined breaking point is provided between the guide section 52 and the electronics section 51 immediately adjacent to the electronics section 51, so that sharp edges at the electronics section 51 are avoided as far as possible and the electronics section 51 is as small as possible after the guide section 52 is broken off. In the described embodiment, the webs 53 have a reduced thickness on their side facing the electronics section 51, via which they can be easily broken off from the electronic sections 51.

LIST OF REFERENCE SIGNS

1 jacket
2 light emitter unit
3 motion sensor
4 control unit
5 touch switch
6 vibration unit
7 sensor of sensor unit
10 lower end
11 sensor region
12 sensor-free region
20 side seam
30 sleeve
40 shoulder
50 sequin
51 electronics section
52 guide section
53 web
100 front side
200 back side
510 microprocessor
511 sewing recess
512 conductive trace
520 guide hole
Z vertical

What is claimed is:

1. An article of clothing comprising:

a plurality of cut parts, each cut to size from a fabric, which are sewn together, the article of clothing having electronic components, wherein as electronic components, the article of clothing comprises at least one sensor unit for detecting a presence of an external object, a control unit and an electronic signal generator unit, the control unit being configured to receive measured values from the sensor unit during an operating phase of the article of clothing and to transmit control signals generated as a function of the read measured values to the signal generator unit, the signal generator unit being configured to output, on receipt of a predefined control signal, a predefined signal which can be perceived by a wearer of the article of clothing and/or by an external observer of the article of clothing, wherein the electronic components are integrated in the article of clothing in such a way that the article of clothing can be reversibly bent and/or folded within a distance of less than 3 cm starting from any point at which the electronic components are located, wherein at least one of the electronic components has at least one sequin formed as a printed circuit board equipped with electronic functional elements, which sequin has an extension of less than 3 cm, in all directions, and on which contacts are provided via which it is connected to a conductive yarn connected to at least one of the cut parts, the sequin having at least one sewing recess at the border of which one of the contacts is formed, the conductive yarn running through the sewing recess and abutting the border thereof and fixing the border of the sewing recess to the cut part.

2. The article of clothing according to claim 1, wherein at least some of the electronic components are non-detachably connected to the respective fabric from which the respective cut part is cut to size, at which the respective electronic component is arranged.

3. The article of clothing according to claim 1, wherein the control unit includes a link to a computing unit in which an evaluation logic is stored, the control unit being configured to evaluate the measured values received from the sensor unit with the stored evaluation logic and to output control signals to the signal generator unit as a function of an evaluation result obtained by the evaluation logic.

4. The article of clothing according to claim 1, wherein the electronic functional elements comprise a capacitor, transistor, conductive trace, coil, diode, microprocessor, microcontroller, converter circuit, loudspeaker module and/or transformer and the electronic functional elements of the sequin being encapsulated in a waterproof cover.

5. The article of clothing according to claim 1, wherein a plurality of sequins are integrated in the article of clothing, which sequins are interconnected by the electrically conductive yarn under formation of an electronic circuit, the conductive traces of which are at least partially formed by the electrically conductive yarn and the electronic functional elements of which are formed by the sequins.

6. The article of clothing according to claim 1, wherein: one side of the sequin is formed as a breaking side, which is formed as a broken edge; or the sequin has a first section formed as an electronics section and a second section formed as a guide section arranged next to the first section, the electronics section of the sequin having the at least one sewing recess and all electronic functional elements of the sequin, and the guide section having an area of at least 20 $mm^2$.

7. The article of clothing according to claim 1, wherein the article of clothing has an outer fabric layer which forms an outer side facing away from the wearer when the article of clothing is worn as intended, and a bottom fabric layer which forms an inner side of the article of clothing facing towards the wearer when the article of clothing is worn as intended, wherein an intermediate space is formed between the outer fabric layer and the bottom fabric layer in which the electronic components are arranged.

8. The article of clothing according to claim 1, wherein the sensor unit includes at least one optical sensor which is configured to output a measured value as a function of a light intensity of light impinging on it, the control unit being configured to control the signal generator unit as a function of the value of the light intensity output as a measured value in order to output a signal, in the dependency being defined in such a way that, in the event of a change in the value of the light intensity by more than a limit value, the signal generator unit is controlled to output the signal.

9. The article of clothing according to claim 1, wherein the sensor unit forms a sensor surface, at least 80% of the sensor surface being arranged in a region at the article of clothing whose outwardly facing surface normal has an angle of at least 30° of the vertical when worn as intended, in which case the wearer stands up straight along a vertical running parallel to the weight force acting on the earth, lets his arms hang straight down along the vertical and directs his eyes to the horizontal.

10. The article of clothing according to claim 1, wherein the signal generator unit has a current consumption of 500 mA to 3000 mA when the signal is output and/or in that the article of clothing has an energy storage, the energy storage ensuring a minimum operating time of 3 hours, in particular 5 hours, when the signal is output continuously by the signal generator unit.

11. The article of clothing according claim 1, wherein the control unit is configured to determine from measured values of the sensor unit whether fog is present in an environment around the article of clothing, the control unit being configured to permanently control the signal generator unit to output the signal in the event of fog being determined in the environment.

12. The article of clothing according claim 1, wherein the article of clothing comprises a motion sensor, the control unit being configured to receive measured values from the motion sensor and to determine from a change in a measured value output by the motion sensor within a predetermined time whether the wearer of the article of clothing has fallen, the control unit being configured to generate an emergency signal when a fall of the wearer is determined.

13. The article of clothing according to claim 1, wherein the article of clothing includes a central switch, wherein the wearer can switch on and off at least one function of the electronic components of the article of clothing via the switch.

14. The article of clothing according to claim 1, wherein the signal generator unit has several light sources distributed over the article of clothing.

15. The article of clothing according to claim 1, wherein the signal generator is configured to output a pulsed signal as the signal output upon receipt of the predefined control signal, wherein the pulse rate is less than one third.

16. The article of clothing according to claim 1, wherein the electronic components are integrated in the article of clothing in such a way that the article of clothing is washable at 30° C.

17. The article of clothing according to claim 1, wherein the control unit has an interface for coupling a mobile electronic device.

18. The article of clothing according to claim 1, wherein the article of clothing is a jacket, wherein the sensor unit extends at least partially over a back side and a front side of the jacket, and/or the signal generator unit extends at least partially over the back side and the front side of the jacket.

19. A method of manufacturing an article of clothing according to claim 1, wherein plural cut parts, each cut to size from a fabric, are sewn together, wherein in a working step for creating an electronic component integrated in one of the cut parts, a sequin is fixed to the cut part by means of a sequin embroidery machine, which sequin is formed as a board equipped with electronic functional elements and having an electronics section and a guide section rigidly connected to this electronic section, the electronics section having all the electronic functional elements of the sequin, wherein during the working step, the sequin embroidery machine grips the sequin at its guide section by means of a guide device and guides it into a predetermined position relative to the cut part and then mechanically fixes the sequin to the cut part through at least one sewing recess provided in the electronics section using an electrically conductive yarn, and subsequently further sequins are mechanically fixed to the cut part with the electrically conductive yarn under electrically conductive contacting of the sequins by means of the electrically conductive yarn.

20. The method according to claim 19, wherein during the working step, the guide device engages with a guide mandrel in a guide hole provided in the guide section.

21. A set of sequins for creating an article of clothing according to claim 1, wherein each of said sequins comprises a first section formed as an electronics section and a second section formed as a guide section arranged next to said first section, wherein the electronic section of the sequin comprises at least one sewing recess and all electronic functional elements of the sequin, and the guide section has an area of at least 20 $mm^2$.

22. The article of clothing according to claim 6, wherein:

a guide hole for a mandrel of a sequin embroidery machine is provided in the guide section and/or the sequin is fixed to the cut part exclusively within its electronics section.

23. The article of clothing according to claim 18, wherein:

the signal generator unit is configured to output a mechanical signal to the wearer, and the signal generator unit extends on at least one sleeve and/or on at least one shoulder.

24. The article of clothing according to claim 19, wherein:

after the mechanical fixing of the electronics section, the guide section is broken off from the latter and removed from the cut part.

* * * * *